United States Patent [19]

Ruede

[11] Patent Number: 4,468,430

[45] Date of Patent: Aug. 28, 1984

[54] ASPHALT SHINGLE WITH GLASS FIBER MAT

[75] Inventor: Paul P. Ruede, Newark, Ohio

[73] Assignee: Owens-Corning Fiberglas Corporation, Toledo, Ohio

[21] Appl. No.: 452,666

[22] Filed: Dec. 23, 1982

[51] Int. Cl.[3] ..... B32B 9/00

[52] U.S. Cl. ..... 428/291; 428/143; 428/283; 428/323; 428/489

[58] Field of Search ..... 428/285, 291, 323, 489, 428/141, 143, 283, 325

[56] References Cited

U.S. PATENT DOCUMENTS

| | | | |
|---|---|---|---|
| 2,841,000 | 7/1958 | Coppage . | |
| 4,332,705 | 6/1982 | Uffner | 428/489 |
| 4,405,680 | 9/1983 | Hansen | 428/141 |

FOREIGN PATENT DOCUMENTS

| | | | |
|---|---|---|---|
| 2419373 | 11/1979 | France | 428/291 |
| 2464138 | 4/1981 | France | 428/291 |

*Primary Examiner*—James J. Bell

*Attorney, Agent, or Firm*—Ronald C. Hudgens; Ted C. Gillespie; Paul J. Rose

[57] ABSTRACT

A glass fiber shingle having random butadiene-styrene copolymer added to the coating asphalt for the glass fiber mat.

6 Claims, No Drawings

ASPHALT SHINGLE WITH GLASS FIBER MAT

TECHNICAL FIELD

This invention relates generally to asphalt roofing shingles and more particularly to improvements in glass fiber mat based asphalt shingles.

BACKGROUND ART

Glass fiber mat based asphalt shingles tend to be brittle and to crack upon handling in cold weather.

U.S. Pat. No. 4,328,147 discloses glass fiber mat based asphalt shingles wherein the asphalt composition is modified to reduce cold-weather brittleness and includes 52 to 99 percent oxidized asphalt, 1 to 8 percent oxidized polyethylene, and 0 to 40 percent unoxidized asphalt or saturant.

DISCLOSURE OF INVENTION

The addition of a small amount of butadiene-styrene copolymer to the coating asphalt for glass fiber shingle mat greatly reduces brittleness of the shingles in cold weather.

BEST MODE OF CARRYING OUT THE INVENTION

In accordance with the invention, an amount up to about 5%, preferably from 0.5% to 0.75%, and still more preferably about 0.5%, or random butadiene-styrene copolymer solids is added to the coating asphalt for glass fiber shingle mat. The viscosity becomes too great if more than 5% is added. The copolymer solids are added as a latex to heated asphalt, the latex containing about 30% water and 70% solids. The copolymer solids may be about 76% butadiene and 24% styrene. Filler is then added to the modified asphalt, the final composition including from 50% to 70%, preferably about 62%, of filler. The filler is preferably limestone dust.

The addition of as little as 0.5% butadiene-styrene copolymer to the asphalt reduces cold weather brittleness of the glass fiber shingles, enabling them to be installed in temperatures of 35° F. to 45° F. without cracking. Roofers notice a marked improvement in handleability.

All percentages expressed herein are based on weight.

What is claimed is:

1. An asphalt shingle comprising a glass fiber mat coated with a modified asphalt composition including from 96% to 99.5% of asphalt and from 0.5% to 4% of random butadiene-styrene copolymer, based on the combined weights of the asphalt and copolymer.

2. An asphalt shingle as claimed in claim 1 wherein the modified asphalt composition includes from 50% to 70% of filler, based on the combined weights of asphalt, copolymer, and filler.

3. An asphalt shingle as claimed in claim 1 wherein the modified asphalt composition includes from 0.5% to 0.75% of the copolymer.

4. An asphalt shingle as claimed in claim 3 wherein the modified asphalt composition includes from 50% to 70% of filler, based on the combined weights of asphalt, copolymer, and filler.

5. An asphalt shingle as claimed in claim 1 wherein the modified asphalt composition includes about 0.5% of the copolymer.

6. An asphalt shingle as claimed in claim 5 wherein the modified asphalt composition includes from 50 to 70% of filler, based on the combined weights of asphalt, copolymer and filler.

* * * * *